US007108300B2

(12) United States Patent
Hodgin et al.

(10) Patent No.: US 7,108,300 B2
(45) Date of Patent: Sep. 19, 2006

(54) REVERSIBLE LATCH BOLT

(75) Inventors: Chris Hodgin, Louisville, TN (US); J. Steven Gray, Maryville, TN (US)

(73) Assignee: Yale Security Inc., Monroe, NC (US)

( * ) Notice: Subject to any disclaimer, the term of this patent is extended or adjusted under 35 U.S.C. 154(b) by 0 days.

(21) Appl. No.: 10/248,889

(22) Filed: Feb. 27, 2003

(65) Prior Publication Data

US 2004/0169378 A1 Sep. 2, 2004

(51) Int. Cl.
*E05B 15/00* (2006.01)

(52) U.S. Cl. ..... 292/244; 70/462

(58) Field of Classification Search ..... 292/244, 292/169.15, 169.21; 70/462
See application file for complete search history.

(56) References Cited

U.S. PATENT DOCUMENTS

| | | | | |
|---|---|---|---|---|
| 81,931 | A | 9/1868 | Munger | |
| 168,986 | A | 10/1875 | Griscom | |
| 197,531 | A | 11/1877 | Vetter | |
| 235,963 | A | 12/1880 | Prouty | |
| 269,098 | A | 12/1882 | Niles | |
| 286,580 | A | 10/1883 | Billings | |
| 302,657 | A * | 7/1884 | Heizmann | 292/245 |
| 366,998 | A | 7/1887 | Crownfield | |
| 950,108 | A | 2/1910 | Lawrence | |
| 1,057,663 | A | 4/1913 | Page | |
| 1,126,181 | A | 1/1915 | Cleaver | |
| 1,168,525 | A | 1/1916 | Lurie | |
| 1,456,466 | A | 5/1923 | Sauerbrei | |
| 1,469,829 | A | 10/1923 | Teich | |
| 1,627,420 | A | 5/1927 | Thomas | |
| 2,516,991 | A | 8/1950 | Heyer | 292/244 |
| 2,673,758 | A | 3/1954 | Schlage | |
| 2,718,421 | A | 9/1955 | Slopa et al. | 292/165 |
| 2,823,538 | A | 2/1958 | Fresard | 70/462 |
| 3,211,486 | A | 10/1965 | Crandell | 292/348 |
| 3,235,301 | A | 2/1966 | Russell et al. | 292/244 |
| 3,242,706 | A | 3/1966 | Check | 70/110 |
| 3,257,136 | A | 6/1966 | Russell et al. | 292/244 |

(Continued)

FOREIGN PATENT DOCUMENTS

DE 2031370 6/1970

(Continued)

*Primary Examiner*—Gary Estremsky
(74) *Attorney, Agent, or Firm*—Moore & Van Allen PLLC; Michael G. Johnston

(57) ABSTRACT

A latch is provided for a mortise lock of the type comprising a housing for accommodating the lock components. The latch comprises a first and second portions movably mounted in the housing and a securing element for releasably connecting the first and second portions in either a first relative axial position or a second relative axial position where the first and second portions of the latch are rotatable relative to one another. In the first axially connected position of the latch, the first and second portions of the latch are movable together relative to the housing so that the first portion at least partially non-rotatably projects outwardly from the opening in the housing in an extended position of the latch, and the first portion is inside the housing in a retracted position of the latch. In the second axially connected position of the latch, the first portion of the latch extends further outwardly from the opening in the housing so that the first portion is rotatable relative to the housing and the first portion may be rotated to a selected position and returned to the first axially connected position of the first and second portions of the latch.

13 Claims, 6 Drawing Sheets

U.S. PATENT DOCUMENTS

| | | | | | |
|---|---|---|---|---|---|
| 3,361,462 | A | | 1/1968 | Foster | 292/165 |
| 3,361,464 | A | | 1/1968 | Foster | 292/245 |
| RE26,677 | E | | 10/1969 | Russell et al. | |
| 3,631,695 | A | | 1/1972 | Velbert | 70/432 |
| 3,672,714 | A | | 6/1972 | Schultz | 292/34 |
| 3,750,433 | A | | 8/1973 | Sanders | 70/146 |
| 3,769,822 | A | | 11/1973 | Yulkowski | 70/107 |
| 3,808,849 | A | | 5/1974 | Alexander | 70/149 |
| 4,071,270 | A | | 1/1978 | Alexander | 292/169.22 |
| 4,118,056 | A | | 10/1978 | Alexander | 292/169.17 |
| 4,243,256 | A | | 1/1981 | Frydrych | 292/245 |
| 4,286,812 | A | | 9/1981 | Sprekeler | 292/245 |
| 4,333,324 | A | | 6/1982 | Dietrich et al. | 70/107 |
| 4,389,061 | A | | 6/1983 | Foshee | 292/169.14 |
| 4,462,230 | A | | 7/1984 | Evans | 70/383 |
| 4,468,059 | A | | 8/1984 | Nelson et al. | 292/337 |
| 4,470,278 | A | | 9/1984 | Hale et al. | 70/134 |
| 4,470,279 | A | | 9/1984 | Neary et al. | 70/134 |
| 4,583,382 | A | * | 4/1986 | Hull | 70/107 |
| 4,674,776 | A | | 6/1987 | James | 292/40 |
| 4,695,082 | A | | 9/1987 | Marks | 292/169.16 |
| 4,696,174 | A | | 9/1987 | Marks | 70/451 |
| 4,765,663 | A | | 8/1988 | Raymond et al. | 292/169.13 |
| 4,798,065 | A | | 1/1989 | DeForrest, Sr. | 70/129 |
| 4,817,404 | A | | 4/1989 | Eisermann et al. | 70/134 |
| 4,950,005 | A | | 8/1990 | Cudd | 292/150 |
| 4,974,883 | A | | 12/1990 | Jans | 292/169 |
| 4,988,133 | A | * | 1/1991 | Shih | 292/191 |
| 5,123,684 | A | | 6/1992 | Yeh | 292/244 |
| 5,201,200 | A | * | 4/1993 | Hauber | 70/107 |
| 5,259,652 | A | | 11/1993 | Adams et al. | 292/169.14 |
| 5,308,131 | A | | 5/1994 | Galindo et al. | 292/337 |
| 5,395,144 | A | | 3/1995 | Galindo | 292/169.16 |
| 5,604,970 | A | | 2/1997 | Aigner et al. | 29/525 |
| 5,676,407 | A | | 10/1997 | Smallegan et al. | 292/139 |
| 5,678,870 | A | * | 10/1997 | Pelletier | 292/244 |
| 6,349,982 | B1 | * | 2/2002 | Fayngersh et al. | 292/165 |
| 6,393,878 | B1 | | 5/2002 | Fayngersh et al. | 70/107 |

FOREIGN PATENT DOCUMENTS

| | | |
|---|---|---|
| DE | 1938639 | 2/1971 |
| DE | 2136636 | 7/1971 |
| DE | 1938639 | 11/1978 |
| DE | 2160563 | 9/1979 |
| DE | 2827939 | 1/1980 |
| NO | 63812 | 8/1941 |
| WO | WO 94/25709 | 11/1994 |

* cited by examiner

REVERSIBLE LATCH BOLT

BACKGROUND OF INVENTION

This invention relates generally to door latch assemblies, and more particularly to a reversible latch bolt for use with latch assemblies in mortise locks so that the mortise lock can be used with both right-hand and left-hand doors.

A mortise lock fits into a mortised recess formed in the edge of a door which is opposite to the edge of the door that is hinged to the door frame. The mortise lock generally includes a rectangular housing, or case, which encloses the lock components. The principal lock component is a beveled latch bolt which projects beyond the edge of the door and into an opening or strike plate in the door frame to latch the door in a closed position. The latch bolt is moveable to a retracted position inside the case to permit opening of the door by operation of a latch operator, such as a door knob or lever handle.

Adjustments must be made to the mortise lock depending on whether the lock is mounted in a left-hand or right-hand door. A mortise lock mounted in a left-hand door must be rotated 180° about a vertical axis for mounting in a right-hand door. Consequently, the latch bolt must also be rotated 180° about a horizontal axis so that the beveled face of the latch bolt faces the door-closing direction.

Ideally, the necessary adjustments to the mortise lock can be accomplished without opening the case. Typically, the latch bolt can be pulled partially out of the housing, usually against the force of a spring, rotated 180° and then allowed to be pulled back into the housing by the spring. However, this arrangement can lead to tampering after the lock is installed since the latch bolt can be reversed even when the mortise lock is in the door, which would prevent the door from the closing. Moreover, the conventional mechanisms for reversing the operation of the locking mechanism are complicated and difficult to manipulate.

For the foregoing reasons, there is a need for a latch assembly for use in a reversible mortise lock which includes a latch bolt that cannot be reversed after the lock is installed in a door. Reversal of the latch bolt for use with a door of the opposite hand should be easily accomplished in the field. The new latch assembly should be straightforward to manufacture and use.

SUMMARY OF INVENTION

According to the present invention, a latch is provided for a mortise lock of the type comprising a housing for accommodating the lock components including the latch and having at least one opening. The latch comprises a first portion and a second portion adapted to be movably mounted in the housing and a securing element for releasably connecting the first portion and the second portion in either a first relative axial position or a second relative axial position where the first and second portions of the latch are rotatable relative to one another. In the first axially connected position of the latch, the first and second portions of the latch are movable together relative to the housing so that the first portion at least partially non-projects outwardly from the opening in the housing in an extended position of the latch, and the first portion is inside the housing in a retracted position of the latch. In the second axially connected position of the latch, the first portion of the latch extends further outwardly from the opening in the housing so that the first portion is rotatable relative to the housing and the first portion may be rotated to a selected position and returned to the first axially connected position of the first and second portions of the latch.

Also according to the present invention, a mortise lock is provided comprising a housing including two principal side walls and edge walls extending between and interconnecting the side walls. One of the side walls and one of the edge walls of the housing each having at least one opening. A latch bolt is mounted in the housing for movement with respect to the housing. The latch bolt includes a head portion, a rod portion, and a securing element for releasably connecting the head portion and the rod portion in either a first relative axial position or a second relative axial position where the head and rod portions of the latch bolt are rotatable relative to one another. In the first axially connected position, the head and rod portions of the latch bolt are movable relative to the housing so that the head portion at least partially non-rotatably projects outwardly from the opening in the edge wall of the housing in an extended position of the latch bolt and the head portion is inside the housing in a retracted position of the latch bolt. In the second axially connected position, the head portion of the latch bolt extends further outwardly from the opening in the edge wall of the housing so that the head portion is rotatable relative to the housing and the head portion may be rotated to a selected position and returned to the first axially connected position of the head and rod portions of the latch bolt. Means are provided for biasing the latch bolt outwardly of the housing.

BRIEF DESCRIPTION OF DRAWINGS

For a more complete understanding of the present invention, reference should now be had to the embodiments shown in the accompanying drawings and described below.

DETAILED DESCRIPTION

Certain terminology is used herein for convenience only and is not to be taken as a limitation on the invention. For example, words such as "upper," "lower," "left," "right," "horizontal," "vertical," "upward," and "downward" merely describe the configuration shown in the FIGS. Indeed, the components may be oriented in any direction and the terminology, therefore, should be understood as encompassing such variations unless specified otherwise.

The latch bolt assembly according to the present invention is for use in a mortise lock and may be used with any conventional mortise lock such as, for example, the mortise locks described by U.S. Pat. Nos. 4,118,056; 5,678,870; 6,349,982 and 6,393,878, the contents of all which are hereby incorporated by reference. Accordingly, detailed explanations of the functioning of all of the mortise lock components are deemed unnecessary for an understanding of the present invention by one of ordinary skill in the art.

Figure 1:
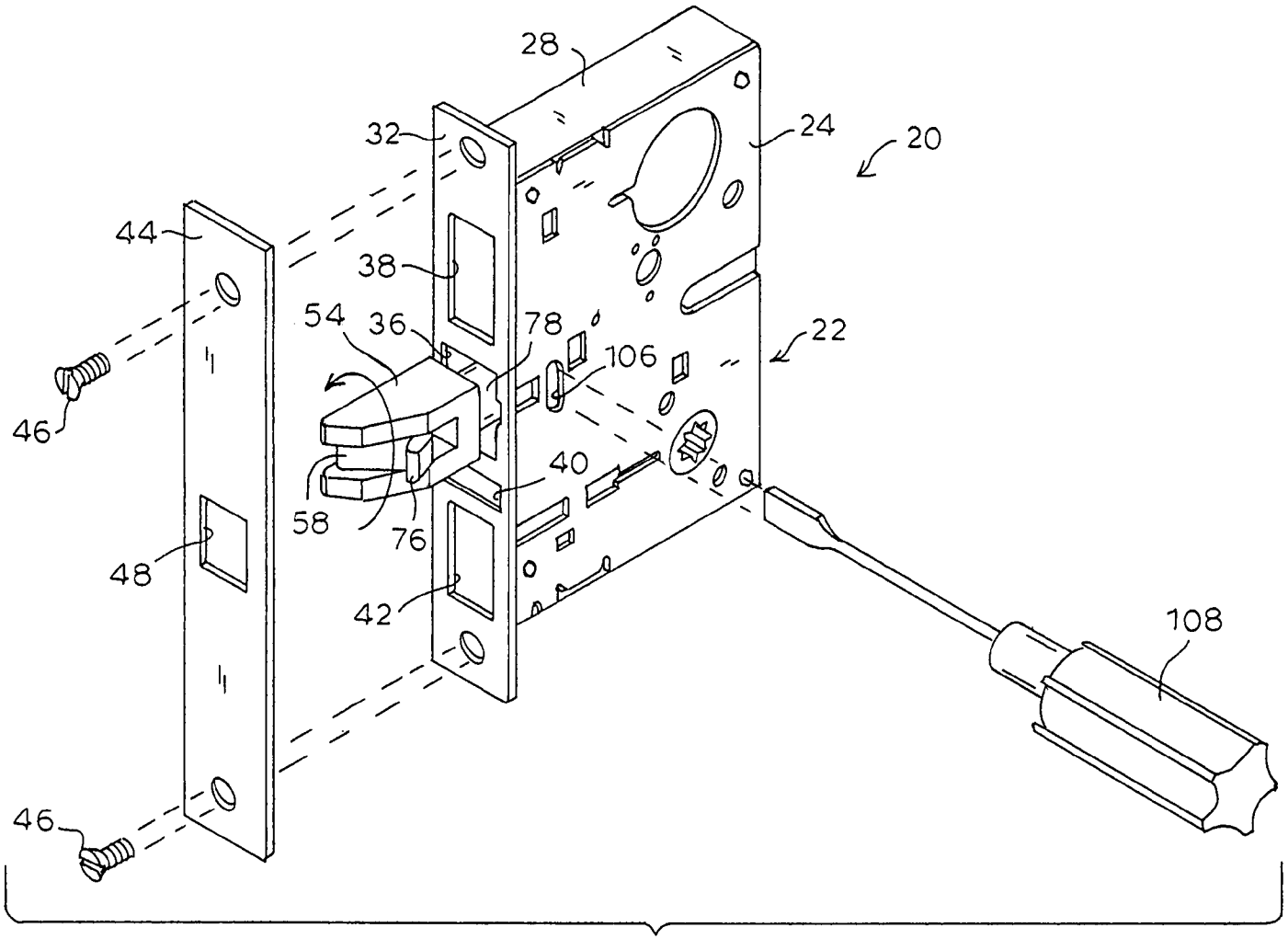
FIG. 1 is a partially exploded perspective view of an embodiment of a mortise lock assembly according to the present invention.

Referring now to FIG. 1, an embodiment of a mortise lock according to the present invention is shown and is generally designated by reference numeral 20. The lock 20 comprises a generally rectangular box, or case 22, for housing the lock components and is adapted to be received in a mortise in the free, or unhinged, edge of a door (not shown). One of the side walls of the case 22 comprises a cap 24 which is secured to and forms a closure for the case 22.

Figure 2:
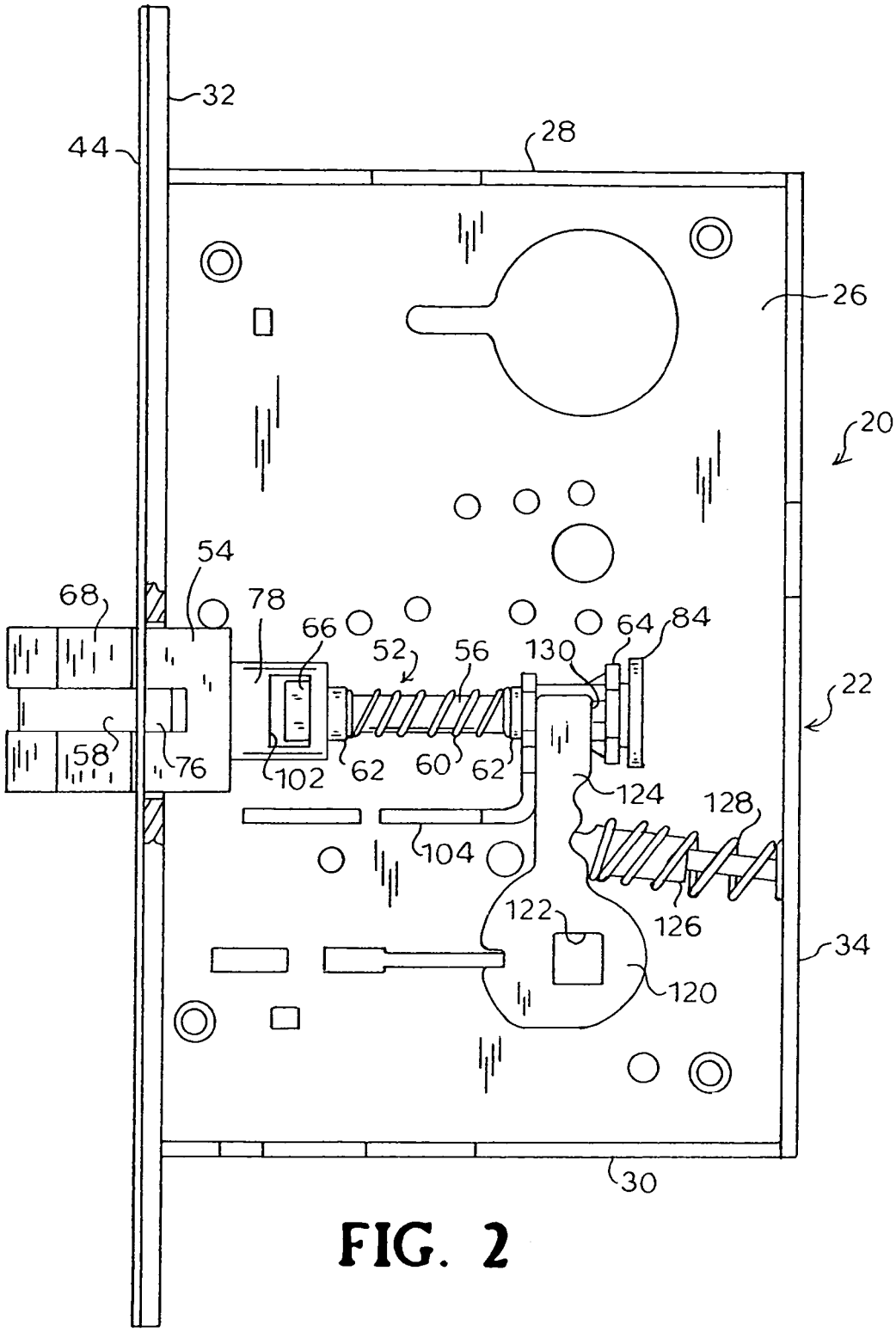
FIG. 2 is a side elevation view of the mortise lock assembly of FIG. 1 with a side wall removed.

FIG. 2 shows the mortise lock 20 with the cap side wall 24 removed. The case 22 includes a side wall 26 and integral top 28, bottom 30, front 32 and rear 34 walls. As seen in FIG. 1, the front wall 32 has a latch bolt opening 36, a deadbolt opening 38, an auxiliary bolt opening 40 and an opening 42 for a flush-mounted toggle. A face plate 44 is secured with screws 46 to the front wall 32 of the case 22 and has an opening 48 for the latch bolt corresponding to the latch bolt opening 36 in the case 22. It is understood that other openings can be provided in the face plate 44 which correspond to the openings in the front wall 42 when the associated lock components are present.

Figure 3:
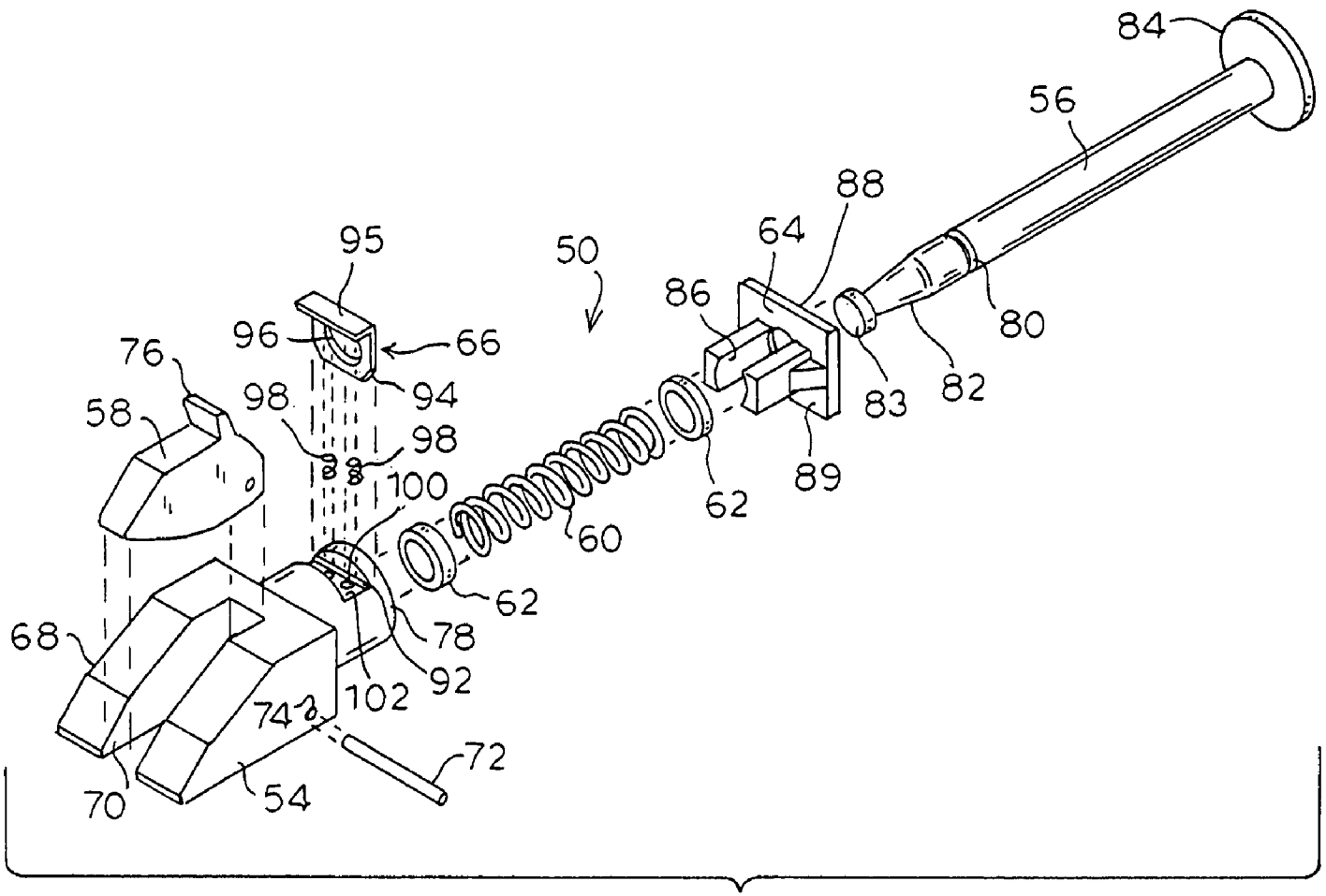
FIG. 3 is an exploded perspective view of an embodiment of a latch assembly according to the present and used in the mortise lock assembly of FIG. 1.

An embodiment of the latch assembly according to the present invention is shown in FIG. 3 and designated generally at 50. The latch assembly 50 comprises a latch bolt including a bolt head 54 and a latch tail 56, an anti-friction lever 58, a coil spring 60, spring washers 62, a guide block 64 and a spring clip 66. The bolt head 54 includes a beveled face 68 and a slot 70. A pin 72 extends through a hole 74 in the bolt head 54, into the slot 70 and a hole in the anti-friction lever 58 for pivotally mounting the anti-friction lever to the bolt head 54. An arm 76 extends from one side of the anti-friction lever and transversely from the beveled face 68 of the bolt head 54. When the latch assembly 50 is in the case (FIGS. 2 and 4), the arm 76 engages behind the face plate 44. The inner end 78 of the bolt head 54 is generally cylindrical and has an axial bore 79 (not seen in FIG. 3) for receiving the outer end of the latch tail 56.

The latch tail 56 has a cylindrical body and a circumferential groove 80 adjacent the outer end of the latch tail 56. The body of the latch tail 56 tapers inwardly beginning at a point spaced longitudinally outwardly from the groove 80. The tapered portion 82 of the latch tail 56 terminates at the outer end of the latch tail 56 forming a disc-like outer end 83 to the latch tail 56. A tail plate 84 is fixed to the inner end of the latch tail 56 transversely to the axis of the latch tail 56.

The guide block 64 is generally cube-shaped and has a pass-through opening 86 for slidably receiving the latch tail 56. The sides of the base 88 of the guide block 64 are flat and slide against the side walls 24, 26 of the case 22 for supporting linear movement of the latch tail 56. The front surface of the base 88 of the guide block 64 serves as a retraction surface 89.

The spring clip 66 is an L-shaped piece, the longer leg 94 of the spring clip defining a circular opening 96. The inner end 78 of the bolt head 54 has a transverse slot 92 for receiving the spring clip 66 and which intersects the axial latch tail bore 79. Two coil springs 98 are disposed in depressions 100 in a transverse channel 102 in the inner end of the bolt head 78.

Figure 4:
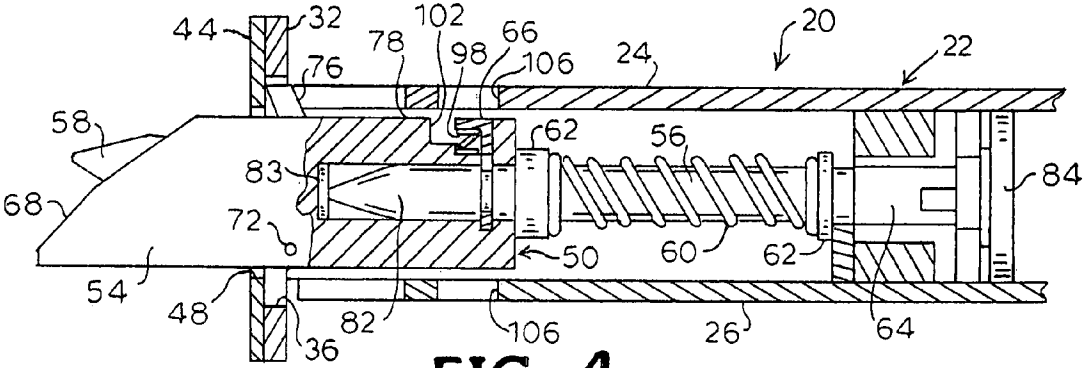
FIG. 4 is a longitudinal sectional view of the latch assembly of FIG. 3 in the mortise lock.

In FIGS. 2 and 4, the latch bolt is shown in an extended position in the mortise lock 20 with the bolt head 54 partially projecting from the opening 36 in the front wall 32 and face plate 44. The latch tail 56 extends rearwardly from the bolt head 54 through a guide slot formed in a boss 104 fixedly mounted between the side walls 24, 26 for guiding and supporting the linear reciprocal movement of the latch bolt. The spring clip 66 is disposed in the slot 92 in the bolt head 54 such that the opening 96 in the spring clip 66 aligns with the axial bore 79 in the bolt head 54. The springs 98 under the shorter leg 95 of the spring clip 66 bias the spring clip 66 away from the bolt head 54. As shown in FIG. 4, the edge of the spring clip opening 96 fits into the groove 80 in the latch tail 56. The bolt head 54 and latch tail 56 are thus secured to move together during normal operation of the mortise lock 20. The coil spring 60 is held in compression between the bolt head 54 and the boss 104 for biasing the latch bolt outwardly to the extended position.

As is conventional, the latch bolt is moveable in the openings in the front wall 32 of the case 22 and face plate 44 to the retracted position inside the case 22 by operation of a latch operator comprising either an inside or outside knob or lever handle or a cylinder lock (not shown). In the embodiment shown, retracting means comprises at least one rollback hub 120 rotatably mounted in the case 22 below the latch assembly 50 (FIG. 2). The hub 120 includes a square aperture 122 for non-rotatable connection to a spindle drive (not shown) connected to the knobs or lever handles for rotating the hub 120. The hub 120 has an upwardly extending leg 124. The upper portion of the leg 124 has a rearwardly facing bearing surface 130 for engaging the front retraction surface 89 of the guide block 64. The latch bolt is retracted by rotating the hub 120 in a clockwise direction, as seen in FIG. 2. Rotation of the hub 120 causes the bearing surface 130 to engage the retraction surface 89 of the guide block 64 to move the latch bolt linearly inward to the retracted position. A spring arm 126 is mounted transversely in the rear wall 34 of the case 22. A coil spring 128 fits around the arm 126 and acts between the rear wall 34 and the hub 120 to urge the hub 120 toward engagement with the boss 104 for restoring the hub 120 to the neutral or home position, shown in FIG. 2, when the latch operator is released. It is understood that the mortise lock assembly may have independent hubs to which inside and outside spindle drives are connected, respectively.

In addition, the latch bolt automatically retracts when the anti-friction lever 58 and the beveled face 68 of the bolt head 54 engage the door frame or strike upon closing of the door. Initially, the anti-friction lever 58 engages the door frame pivoting the anti-friction lever on the pin 72 in the bolt head 54. As the anti-friction lever 58 pivots, the arm 76 works against the inner surface of the face plate 44 driving the latch bolt 52 rearward into the case 22. When the latch operator is released, or the door is in the door frame, the coil spring 60 returns the latch bolt to the extended position.

According to the present invention, the latch bolt is reversible for use with a door of the opposite hand. In order to reverse the latch bolt, it is necessary to disconnect the bolt head 54 from the latch tail 56, rotate the bolt head 54 relative to the latch tail 56 and the lock case 22, and reconnect the bolt head 54 to the latch tail 56. This operation is shown in FIGS. 1 and 5–7.

Figure 5:
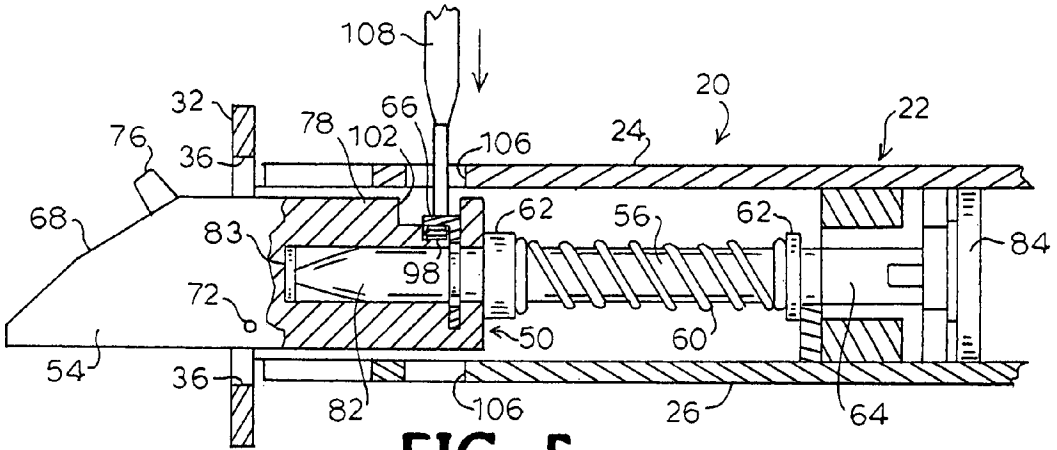
FIGS. 5–7 are longitudinal sectional views of a method for reversal of the latch bolt according to the present invention.
Figure 6:
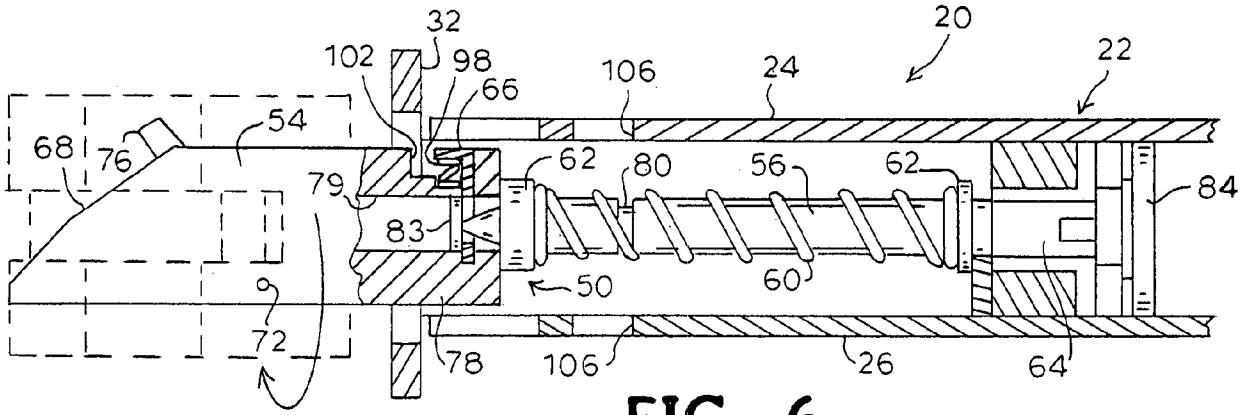

The first step is to remove the face plate 44, as seen in FIG. 1. Next, the spring clip 66 is manually depressed by inserting a tool, such as a screw driver 108, through an opening 106 in the cap side wall 24. As seen in FIG. 5, pressing on the spring clip 66 with a screw driver 108 pushes the spring clip 66 downwardly against the force of the springs 98 thereby aligning the opening 96 in the spring clip 66 and the axial bore 79 in the bolt head 54 freeing the latch tail 56 from the spring clip 66 for movement relative to the bolt head 54. The bolt head 54 is then biased by the spring 60 outwardly of the case 22 through the opening 36 in the front wall 32 (FIGS. 1 and 6). As bolt head 54 moves outward of the case 22, the flange 95 on the spring clip 66 moves out from under the tip of the screwdriver 108. This allows the spring clip 66 to snap outward of the bolt head 54 under the force of the springs 98. As the bolt head 54 continues to move outward, the spring clip 66 advances along the tapered portion 82 of the latch tail 56 until the spring clip engages behind the disc-like outer end 83 of the latch tail 56. In this position, only the inner cylindrical portion 78 of the bolt head 54 remains in the case 22 so that the bolt head 54 is free to rotate on the latch tail 56.

Figure 7:
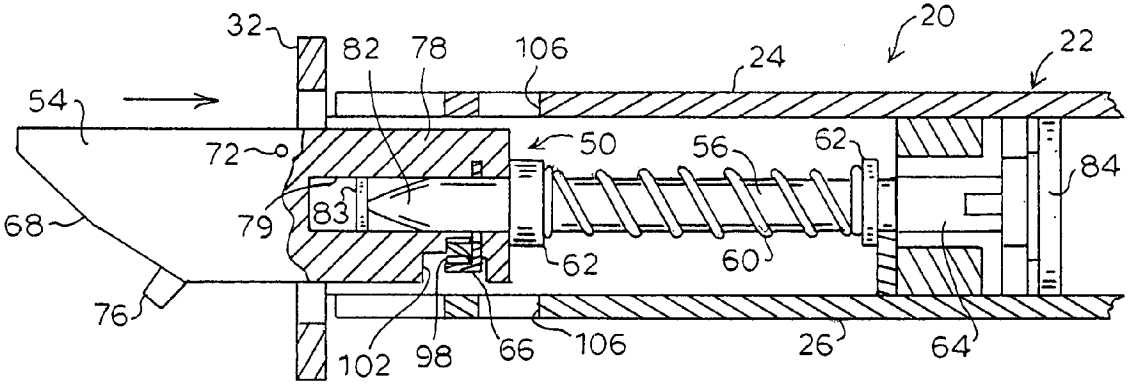

The bolt head 54 is rotated 180° (FIGS. 1 and 6) and pushed back into the case 22. FIG. 7 shows the bolt head 54 during reinsertion into the case 22 along the latch tail 56. Since the outer end of the latch tail 56 is already in the axial bore 79 in the bolt head 54, reinsertion of the bolt head 54 is guided by the latch tail 56. As the bolt head 54 moves into the case 22 along the latch tail 56, the edge of the opening 96 in the spring clip 66 engages and advances along the tapered portion 82 of the latch tail 56 forcing the spring clip 66 into the 92 (as seen in FIG. 7) against the force of the springs 98. The bolt head 54 is advanced into the case 22 until the relative position of the bolt head 54 and latch tail 56 is such that the spring clip 66 is again received in the circumferential groove 80 in the latch tail 56 securing the bolt head 54 and latch tail 56. The face plate 44 is replaced such that the arm 76 on the anti-friction latch 58 is behind the face plate 44. It is understood that the spring clip 66 is now accessible through an opening 106 in the cap side wall 26 in the event that the user desires to reverse the described process and return the bolt head 54 to the prior position.

Figure 8:
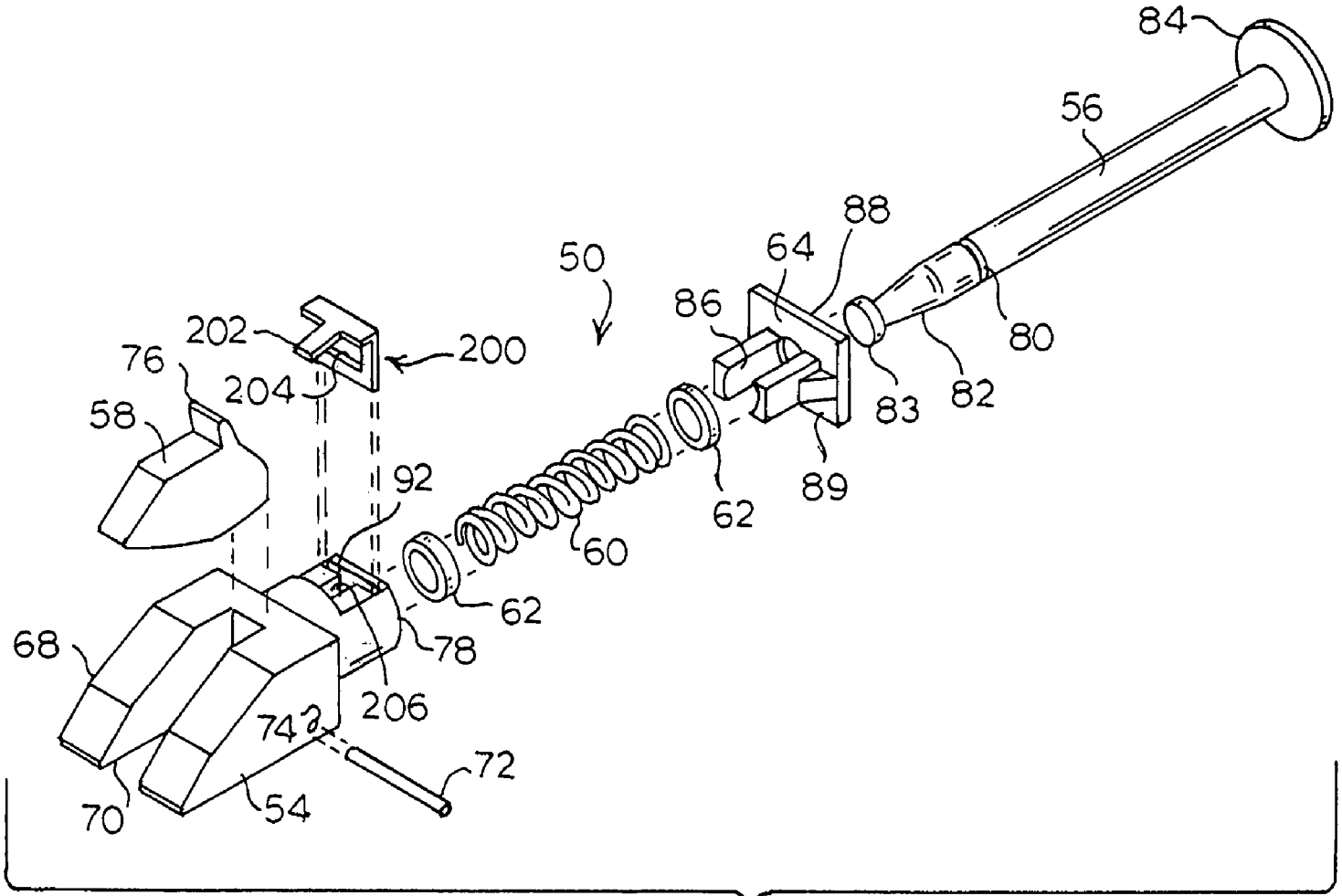
FIG. 8 is an exploded perspective view of an embodiment of a latch assembly according to the present and used in the mortise lock assembly of FIG. 1.

It is understood that the embodiments of the inner portion 78 of the bolt head 54 and the spring clip 66 are exemplary and other structures are possible, as long as such other structures releasably hold the bolt head 54 and latch tail 56 for movement together and, when released, allows the bolt head 54 to move axially relative to the latch tail 56 and rotatably relative to the case 22 without disconnection from the latch tail 56. Other means for biasing the spring clip 66 to the position where the spring clip 66 partially blocks the axial bore 79 in the bolt head 54 are possible. For example, FIG. 8 shows an alternative embodiment of the spring clip for use in the latch assembly 50 of the present invention, generally designated at 200. This embodiment of the spring clip 200 includes an angled tab 202 extending from one edge of the clip 200. The spring clip tab 202 works against a surface 206 of the inner end 78 of the bolt head 54. This embodiment of the spring clip 200 functions without the coil springs 98 if the material of the spring clip is flexible enough to allow the clip 200 to be pushed down to align the opening 204 in the spring clip 200 with the bolt head bore 79. Thus, we do not intend to limit ourselves to the specific embodiments of the bolt head and spring clip, or the spring clip biasing means, shown herein.

The previously described embodiments of the present invention have many advantages, including the provision of a reversible mortise lock which cannot be tampered with after installation. The releasing mechanism of the latch assembly is only accessible through the side walls of the mortise lock case. Therefore, latch bolt reversal must be performed before the lock is installed in the door. Moreover, the latch bolt reversal does not require removal of the entire latch bolt from the case. The mortise lock incorporating the new latch assembly is easily modified for use with either a right-hand door or a left-hand door from outside of the lock casing with a screw driver. The latch assembly is simple to reverse in the field prior to installation in the door.

Although the present invention has been shown and described in considerable detail with respect to only a few exemplary embodiments thereof, it should be understood by those skilled in the art that we do not intend to limit the invention to the embodiments since various modifications, omissions and additions may be made to the disclosed embodiments without materially departing from the novel teachings and advantages of the invention, particularly in light of the foregoing teachings. For example, several means are possible for releasably securing the latch tail to the bolt head. Accordingly, we intend to cover all such modifications, omission, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

The invention claimed is:

1. A mortise lock, comprising:

a housing including two principal side walls and edge walls extending between and interconnecting the side walls, one of the side walls and one of the edge walls of the housing each having at least one opening;

a latch bolt mounted in the housing for movement with respect to the housing, the latch bolt including a head portion, a rod portion, the rod portion connected to the head portion for relative axial movement of the head portion along the rod portion, and a securing element for releasably connecting the head portion and the rod portion in either a first relative axially connected position or a second relative axially connected position where the head and rod portions of the latch bolt are rotatable relative to one another, wherein the head and rod portions of the latch bolt in the first axially connected position are movable together relative to the housing so that the head portion at least partially non-rotatably projects outwardly from the opening in the edge wall of the housing in an extended position of the latch bolt and the head portion is inside the housing in a retracted position of the latch bolt, and in the second axially connected position the head portion of the latch bolt extends further outwardly from the opening in the edge wall of the housing so that the head portion is rotatable relative to the housing and the head portion may be rotated to a selected position and returned to the first axially connected position of the head and rod portions of the latch bolt; and means for biasing the latch bolt outwardly of the housing.

2. A mortise lock as recited in claim 1, wherein the head portion has an opening for reciprocally receiving an end of the rod portion.

3. A mortise lock comprising:

a housing including two principal side walls and edge walls extending between and interconnecting the side walls, one of the side walls and one of the edge walls of the housing each having at least one opening;

a latch bolt mounted in the housing for movement with respect to the housing, the latch bolt including a head portion, a rod portion, and a securing element for releasably connecting the head portion and the rod portion in either a first relative axial position or a second relative axial position where the head and rod portions of the latch bolt are rotatable relative to one another, wherein the securing element is movably associated with the head portion of the latch bolt and comprises a blocking surface, and further comprising means for biasing the securing element to a position where the blocking surface engages the rod portion of the latch bolt for securing together the head and rod portions, wherein the head and rod portions of the latch bolt in the first axially connected position are movable relative to the housing so that the head portion at least partially non-rotatably projects outwardly from the opening in the edge wall of the housing in an extended position of the latch bolt and the head portion is inside the housing in a retracted position of the latch bolt, and in the second axially connected position the head portion of the latch bolt extends further outwardly from the opening in the edge wall of the housing so that the head portion is rotatable relative to the housing and the head portion may be rotated to a selected position and returned to the first axially connected position of the head and rod portions of the latch bolt; and means for biasing the latch bolt outwardly of the housing.

4. A mortise lock as recited in claim 3, wherein the securing element further comprises a disengaging surface which when pressed moves the securing element relative to the head and rod portions of the latch bolt against the force of the biasing means to a position where the blocking surface does not engage the rod portion of the latch bolt for freeing the head and rod portions of the latch bolt for relative movement, wherein the disengaging surface is accessible through the opening the principal side wall of the housing.

5. A mortise lock comprising:

a housing including two principal side walls and edge walls extending between and interconnecting the side walls, one of the side walls and one of the edge walls of the housing each having at least one opening;

a latch bolt mounted in the housing for movement with respect to the housing, the latch bolt including a head portion, wherein the head portion has an opening for receiving an end of the rod portion, a rod portion, and a securing element for releasably connecting the head portion and the rod portion in either a first relative axial position or a second relative axial position where the head and rod portions of the latch bolt are rotatable relative to one another, wherein the securing element is moveably associated with the head portion of the latch bolt and has a blocking surface, and further comprising means for biasing the securing element into a blocking position where the blocking surface partially closes the opening in the head portion of the latch bolt and engages the surface of the rod portion for securing the rod portion in the opening in the head portion of the latch bolt in either the first relative axial position or the second relative axial position, wherein the head and rod portions of the latch bolt in the first axially connected position are movable relative to the housing so that the head portion at least partially non-rotatably projects outwardly from the opening in the edge wall of the housing in an extended position of the latch bolt and the head portion is inside the housing in a retracted position of the latch bolt, and in the second axially connected position the head portion of the latch bolt extends further outwardly from the opening in the edge wall of the housing so that the head portion is rotatable relative to the housing and the head portion may be rotated to a selected position and returned to the first axially connected position of the head and rod portions of the latch bolt; and means for biasing the latch bolt outwardly of the housing.

6. A mortise lock as recited in claim 5, wherein the securing element has a surface accessible from outside of the lock housing through the opening in the principal side wall which surface, when pressed, moves the securing element against the force of the biasing means to a releasing position where the blocking surface is out of the opening in the head portion of the latch bolt for freeing the head and rod portions of the latch bolt for relative movement.

7. A mortise lock as recited in claim 5, wherein the securing element comprises a substantially flat plate having an opening and the blocking surface comprises an edge of the plate defining the opening, and wherein the head portion of the latch bolt has a slot transverse to the axis of the opening in the head portion for receiving the plate so that the openings in the plate and head portion are only partially aligned when the biasing means biases the plate into the blocking position.

8. A mortise lock as recited in claim 7, wherein the plate includes a flange extending from the plate, the flange adjacent a surface of the head portion of the latch bolt when the plate is in the slot, and the biasing means comprises a spring disposed between the flange and the surface of the head portion of the latch bolt.

9. A mortise lock latch as recited in claim 7, wherein the biasing means comprises a resilient tab extending from the periphery of the plate and engaging a surface of the head portion of the latch bolt when the plate is in the slot.

10. A mortise lock as recited in claim 5, wherein each of a first axial position and a second axial position positions along the axis of the rod portion of the latch bolt has a smaller cross-sectional area where engaged by the securing element in the first axially connected position and the second axially connected position than the immediately adjacent portions of the rod portion.

11. A mortise lock as recited in claim 10, wherein the second axial position along the axis of the rod portion of the latch bolt has a smaller cross-sectional area than the first axial position and the cross-sectional area of the rod portion between the first and second axial positions tapers inwardly toward the second axial position.

12. A mortise lock latch as recited in claim 11, wherein the rod portion comprises a flange transverse to the longitudinal axis of the elongated member and adjacent to the second axial position of the rod portion.

13. A mortise lock latch as recited in claim 10, wherein the first axial position of the rod portion has a groove for receiving the securing element in the first axially connected position.

* * * * *